US005548299A

United States Patent [19]

Tsuda et al.

[11] Patent Number: 5,548,299

[45] Date of Patent: Aug. 20, 1996

[54] COLLINEARLY POLARIZED NESTED CUP DIPOLE FEED

[75] Inventors: George I. Tsuda; Thomas A. Haeger, both of Fullerton; William A. Leeper, Anaheim, all of Calif.

[73] Assignee: Hughes Aircraft Company, Los Angeles, Calif.

[21] Appl. No.: 841,594

[22] Filed: Feb. 25, 1992

[51] Int. Cl.[6] ..... H01Q 1/42

[52] U.S. Cl. ..... 343/789; 343/797; 343/810

[58] Field of Search ..... 343/789, 797, 343/810, 817; H01Q 21/26, 1/42, 21/00

[56] References Cited

U.S. PATENT DOCUMENTS 4,042,935 8/1977 Ajioka et al. ..... 343/795

4,218,685 8/1980 Ellis ..... 343/789

4,649,391 3/1987 Tsuda et al. ..... 343/789

*Primary Examiner*—Theodore M. Blum

*Attorney, Agent, or Firm*—Georgann S. Grunebach; M. W. Sales; W. K. Denson-Low

[57] ABSTRACT

A nested cup dipole feed capable of collinear polarization for all bands, and frequency staggering of one linear polarization with respect to the orthogonal linear polarization. The dipole elements for all bands are collinearly placed, making one linearly polarized set to be orthogonal to the other collinear sets. One collinearly placed dipole can be tuned differently from the orthogonal ones to permit frequency staggering at the crossover frequencies, thus permitting at least high gain for one polarization.

5 Claims, 6 Drawing Sheets

COLLINEARLY POLARIZED NESTED CUP DIPOLE FEED

BACKGROUND OF THE INVENTION

This invention relates to high frequency antenna systems and more specifically to wideband feeds for use in such antenna systems.

U.S. Pat. No. 4,042,935, entitled "Wideband Multiplexing Antenna Feed Employing Cavity Backed Wing Dipoles," by J. S. Ajioka and G. I. Tsuda, and assigned to a common assignee with this application, describes a nested cup dipole feed for a circularly polarized antenna. The feed covers multiple octave bands. Between each octave, or at the crossover points in frequency, the gain or sensitivity drops by about 7 dB. As represented in FIG. 2 of this patent, the outer four printed circuit elements cover an octave band. A diagonal pair is fed by a balun to provide linear polarization. The orthogonal pair is also fed by a balun to provide orthogonal linear polarization. For the circular polarized application, the two orthogonal linearly polarized dipoles are fed by a 90 degree hybrid. Another set of four elements placed 45 degrees with respect to the first set covers the second octave band. The third set of four is again placed 45 degrees with respect to the second set but is colinear with the first set. The elements for each band are positioned 45 degrees from their respective adjacent bands. When the feed is used with a parabolodial reflector with a focal distance to diameter ratio of between 0.3 to 0.45, the average efficiency ranges from 40% to 50%. At the band or frequency crossover, the efficiency drops to about 10%.

The applicability of nested cup dipole feed of U.S. Pat. No. 4,042,935 could be increased if the polarization can be made collinear. For instance, the feed of U.S. Pat. No. 4,042,935 cannot be used for an offset reflector because the dipoles for all bands cannot be aligned radially or circumferentially for all bands. If the dipoles (polarization) are not aligned properly, the asymmetry created by the offset reflector causes depolarization which results in coupling between both dipoles. This causes the efficiency to degrade and the beam to squint as a function of frequency and polarization. Another advantage of collinear arrangement is that there are many cases where vertical and horizontal polarization (in space) are required rather than slant 45 degrees. Other applications may require collinear dipoles with staggered crossover tuning. By tuning one dipole differently with respect to the orthogonal ones, a large efficiency decrease can be avoided for at least one linear polarization at the crossover frequencies. In other words, frequency staggering can be accomplished.

There are many applications requiring that the polarization from one band to another be aligned; that is, all vertical and all horizontal.

It is therefore an object of the present invention to provide a nested cup dipole feed which provides collinear polarization for all bands.

A further object is to provide a nested cup dipole feed which enables frequency staggering of one linear polarization with respect to the orthogonal linear polarization if required, thus permitting at least high gain for one polarization.

SUMMARY OF THE INVENTION

These and other objects and advantages are achieved by a nested cup dipole antenna feed system in accordance with the invention, which comprises a plurality of coaxially disposed conductive cylinders of progressively larger diameters disposed about a common axis. The conductive members are closed at one end thereof to define a plurality of nested annular cavities with common walls therebetween. The open ends of the cavities are in substantial transverse alignment. At least one pair of dipole elements is disposed adjacent the open ends of each of the cavities and electromagnetically coupled thereto. Means are provided for coupling electromagnetic energy between the dipole of elements of each pair. This provides an antenna feed system operating at multiple frequency bands, i.e., one band per cavity.

In accordance with the invention, the respective dipole elements are disposed in a collinear arrangement in relation to corresponding dipole elements for adjacent cavities. To provide a dual polarization feed system, two pairs of dipole elements are disposed adjacent the open ends of each of the cavities, wherein each of the pairs is orthogonal to the other. The collinear placement of the dipole elements for all bands makes one linearly polarized set to be orthogonal to the other collinear set. This arrangement permits consistent polarization throughout the bands. By making one collinear set of dipole elements for a given cavity larger in size than the other set of dipole elements, frequency staggering at the crossover frequencies can be provided.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
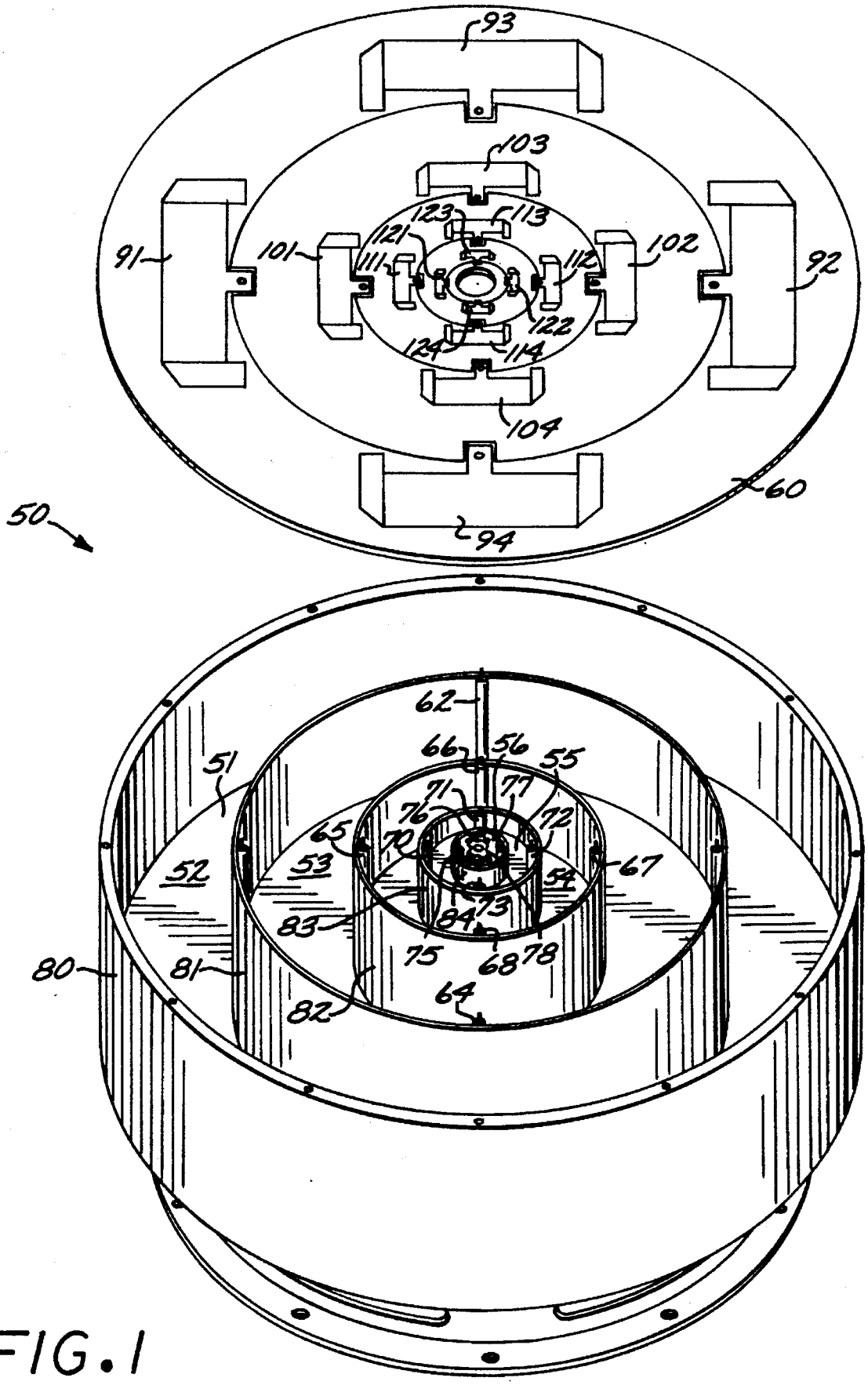
FIG. 1 is a partially exploded perspective view of a preferred embodiment of the present invention.

A nested cup dipole feed 50 in accordance with the invention is illustrated in FIG. 1. This exemplary embodiment comprises five nested cavities 52–56 capable of covering five octave frequency bands. The cavities are defined by nested cylinders 81–84 and groundplane elements 85–89 (FIG. 3), all fabricated of an electrically conductive material.

Coaxial cables soldered in-line provide the means of exciting four dipole elements per cavity which are collinear between each of the five cavities shown. Thus, cables 61–64 provide a means of exciting the dipole elements for cavity 52, cables 65–68 provide a means for exciting the dipole elements for cavity 53, cables 70–73 provide a means for exciting the dipole elements for cavity 54, cables 75–78 provide a means for exciting the dipole elements for cavity 55, and cables 79A–79D (FIG. 5) provide a means for exciting the dipole elements 131–134 for cavity 56. The dipole elements for cavity 56 comprise a crossed dipole pair.

For each polarization sense the two opposite cables are joined with a 180 degree hybrid. A larger or smaller number of octave bands are attainable with the nested cup dipole feed, depending on the application.

Figure 2:
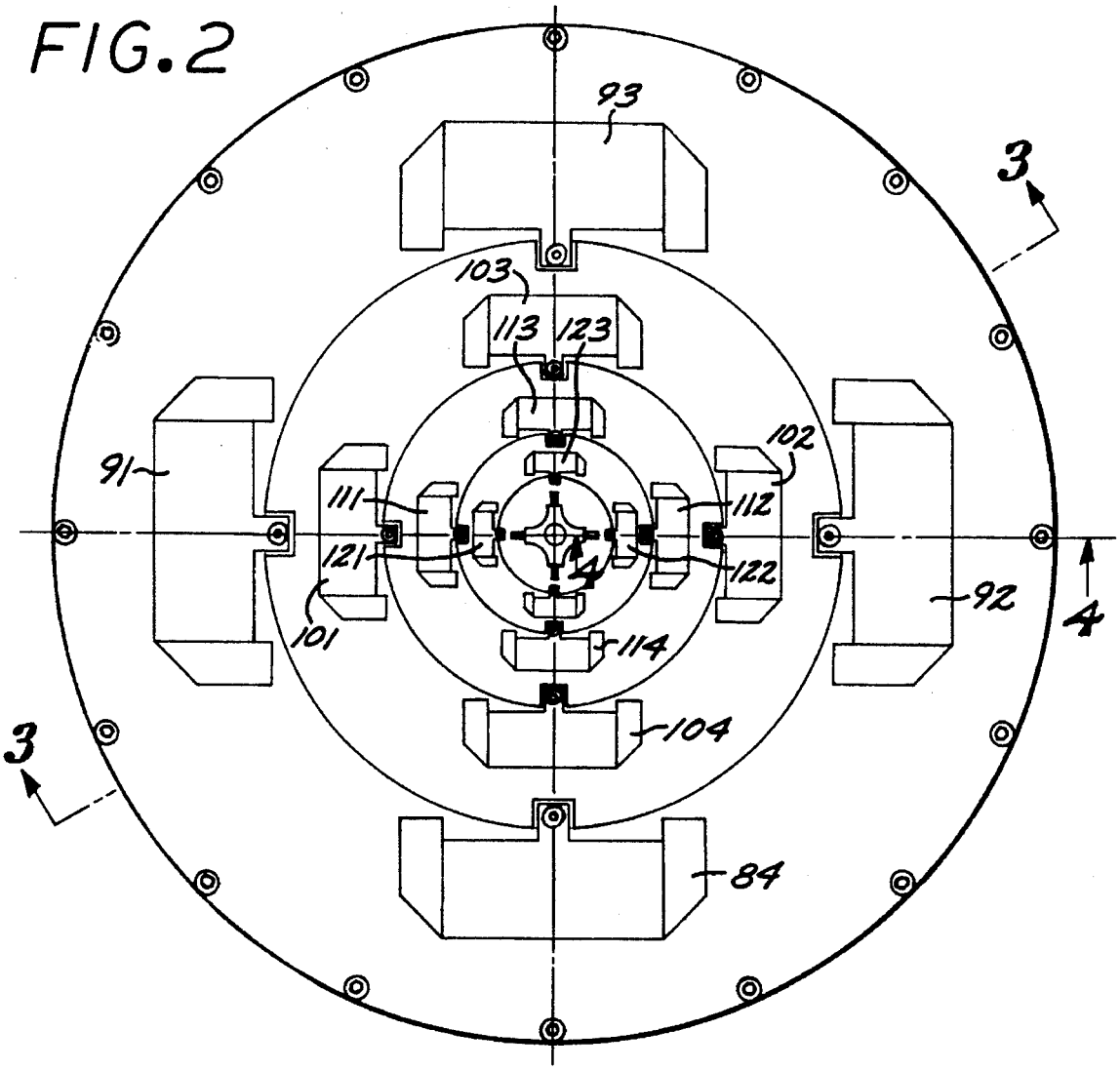
FIG. 2 is a plan view of the embodiment of FIG. 1.

As shown in FIG. 1 and in greater detail in FIG. 2, an etched dipole board 60 is mounted on the front face of the nested cup dipole feed 50. The board 60 comprises a substrate of low loss dielectric material with a pattern of conductive dipole elements defined thereon, e.g., by etching a conductive layer to selectively remove the conductive material and define the dipole elements. Each of the octave bands has four dipole elements which are all collinear with each other. Thus, dipole elements 91–94 are for exciting cavity 52, elements 101–104 are for exciting cavity 53, dipole elements 111–114 are for exciting cavity 54, dipole elements 121–124 are for exciting cavity 55. Crossed dipole elements 131–134 are for exciting the cavity 56.

Compared to the feed of U.S. Pat. No. 4,042,935, intermediate dipole elements are not at a 45 degree angle, but rather are collinear, i.e., aligned along a common axis. Thus, for example, dipole elements 91 and 92 are aligned with the dipole elements 101 and 102 for the adjacent frequency band, instead of at a 45° angle as in the feed of U.S. Pat. No. 4,042,935.

Figure 3:
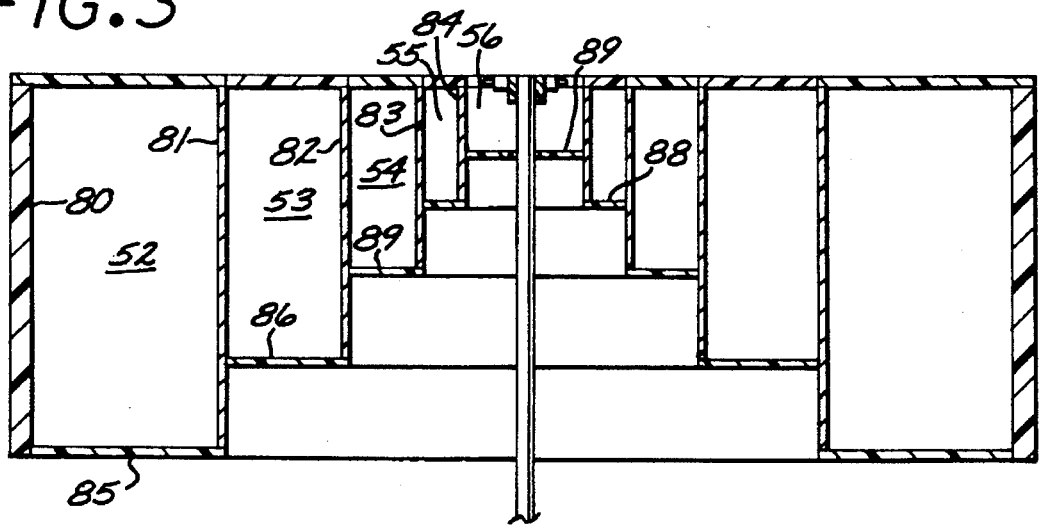
FIG. 3 is a cross-sectional view taken along line 3—3 of FIG. 2.

FIG. 3 is a cross-sectional view taken along line 3—3 of FIG. 2, and illustrates the nested cup structure of the feed system in further detail.

Figure 4:
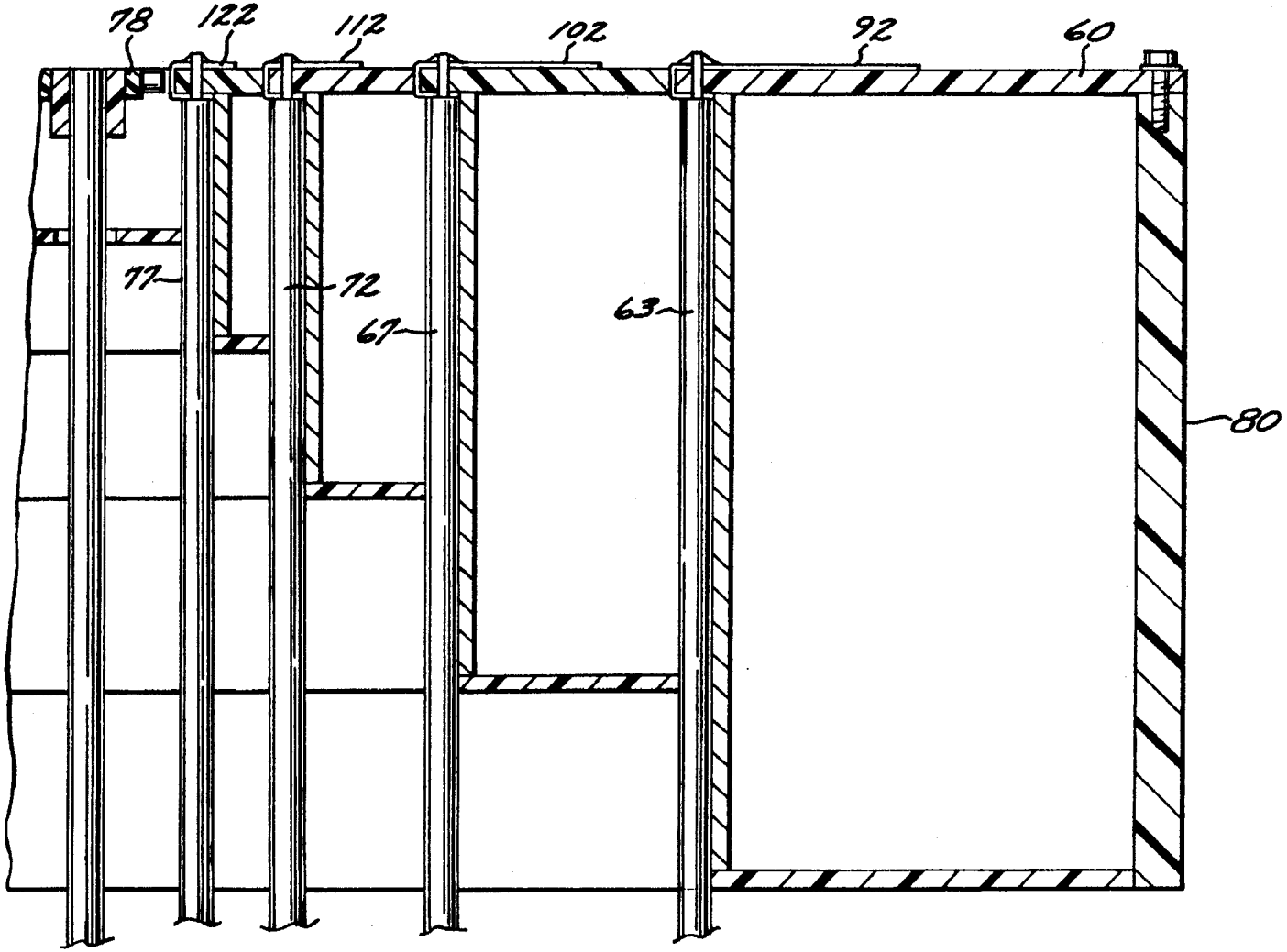
FIG. 4 is a cross-sectional view taken along line 4—4 of FIG. 2.

FIG. 4 is a cross-sectional view taken along line 4—4 of FIG. 2, and illustrates the connection of the coaxial cables to the dipole elements.

The dipole configuration has a staggered crossover capability because one collinear set of dipole elements is physically larger in dimension than the others. For example, elements 93 and 94 are larger than elements 91 and 92 for cavity 52. The larger elements resonate at lower frequency than the smaller elements, thus providing frequency staggering.

Figure 5:
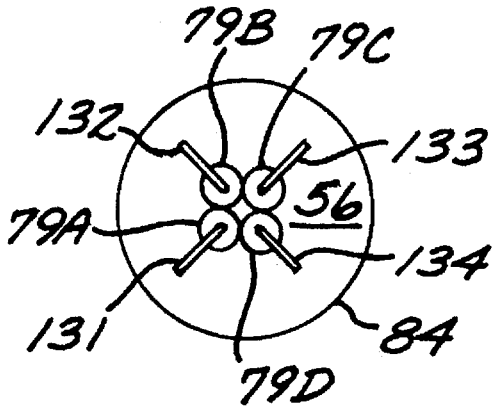
FIGS. 5 and 6 illustrate the crossed dipole pair exciting the innermost cavity of the feed system of claim 1.
Figure 6:
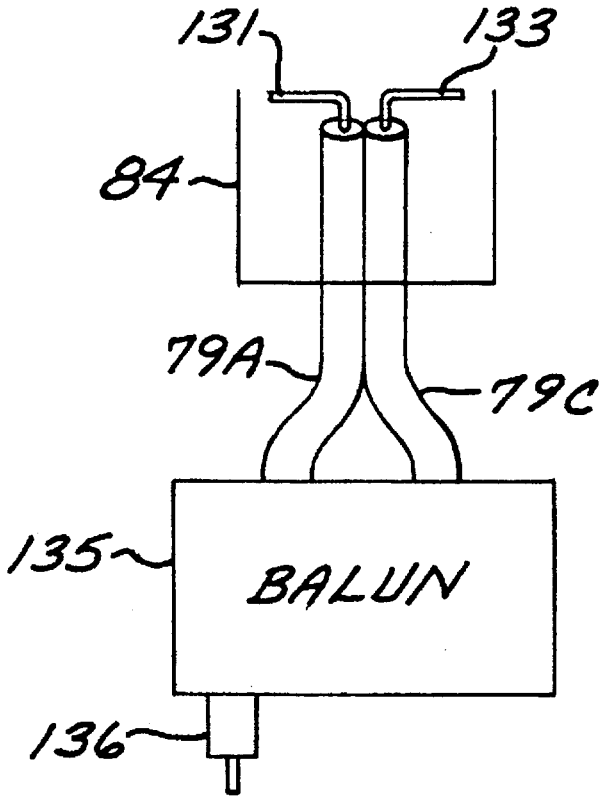

FIG. 5 illustrates the crossed dipole pair which excites the innermost cavity 56. The dipole pair comprises dipole elements 131–134 fed respectively by coaxial cables 79A, 79B, 79C and 79D. To illustrate the manner in which the respective dipole pairs comprising the feed system of FIG. 1 are fed, FIG. 6 shows the dipole elements 131 and 133 comprising one of the dipole element pairs exciting cavity 56. A coaxial cable 136 is connected to the input port of a balun circuit 135; the two outputs of the balun circuit 135 are connected to the cables 79A and 79C. The balun circuit 135 provides the function of dividing the power of the signal provided by cable 136 between the two output ports of the balun, and providing a 180 degree difference in phase between the divided signals at the output ports. Thus, the balun circuit 135 can comprise, for example, a 180 degree hybrid network, or simply a power divider network with one of cables 79A and 79C being longer than the other by an electrical length sufficient to provide a 180 degree phase delay.

Figure 7:
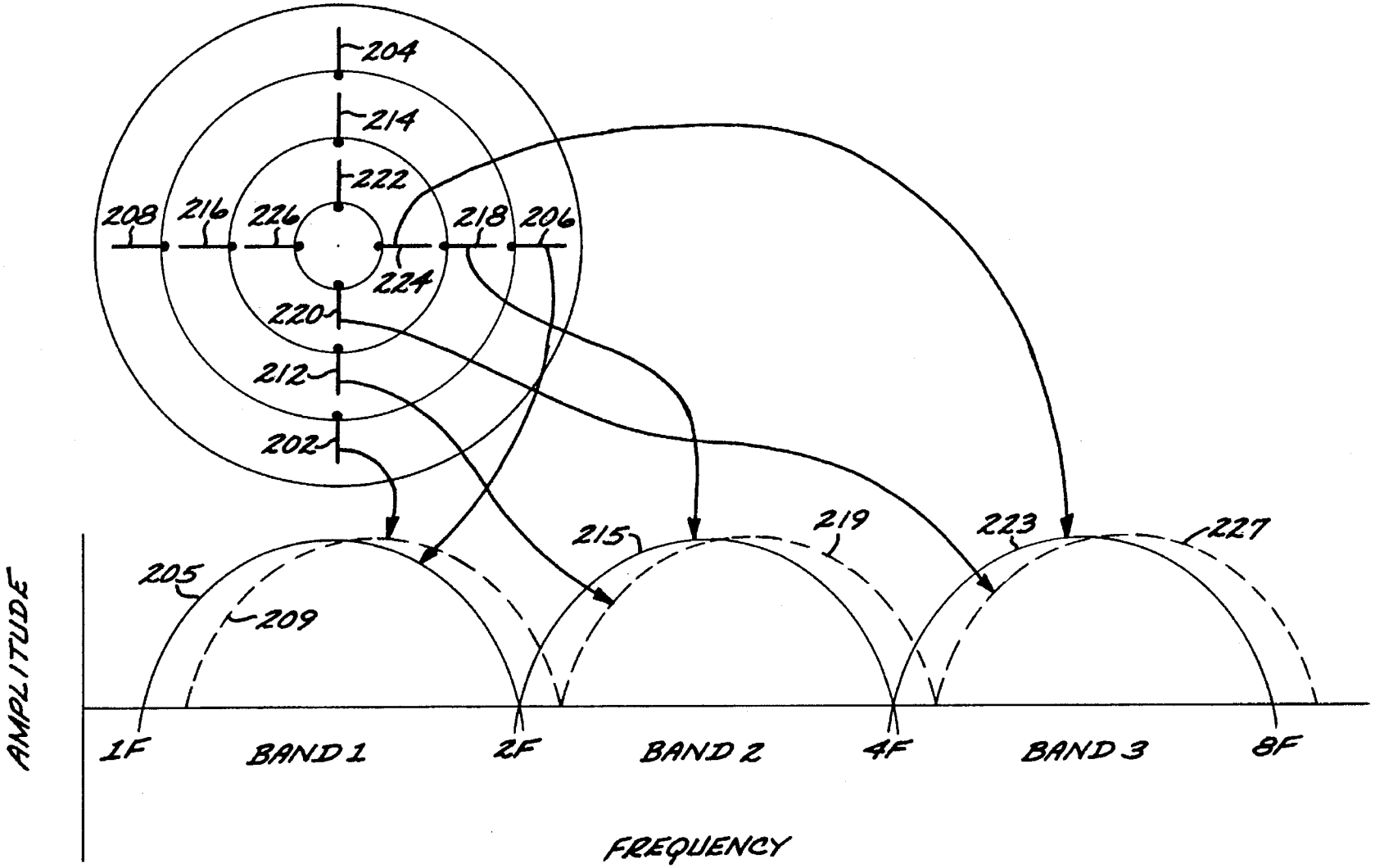
FIG. 7 is a plot of amplitude versus frequency for an antenna feed system employing the invention and providing the capability of frequency staggering.

FIG. 7 illustrates the staggered crossover capability of the antenna feed system of FIG. 1. FIG. 7 includes a plot of antenna feed amplitude versus frequency for three adjacent bands. In this example, band 1 is between frequency F and 2F, band 2 is between 2F and 4F, and band 3 is between 4F and 8F. FIG. 7 also includes a simple depiction of a collinear nested cup dipole feed system 200 in accordance with the invention. Dipole elements 206 and 208 are excited to provide the amplitude pattern 205 in band 1. Dipole elements 202 and 204, disposed adjacent the same cavity as elements 206 and 208 but in the orthogonal sense, are somewhat smaller in size than elements 206 and 208, and their resulting amplitude pattern 209 is staggered or offset from pattern 205. Similarly, for the next adjacent cavity, dipole elements 216 and 218 provide the pattern 215, and orthogonal, smaller sized elements 212 and 214 provide the staggered, offset pattern 219. For the inner cavity of the feed system, elements 224 and 226 provide pattern 223, and orthogonal, smaller sized elements 220 and 222 provide the staggered, offset pattern 227.

Figure 8:
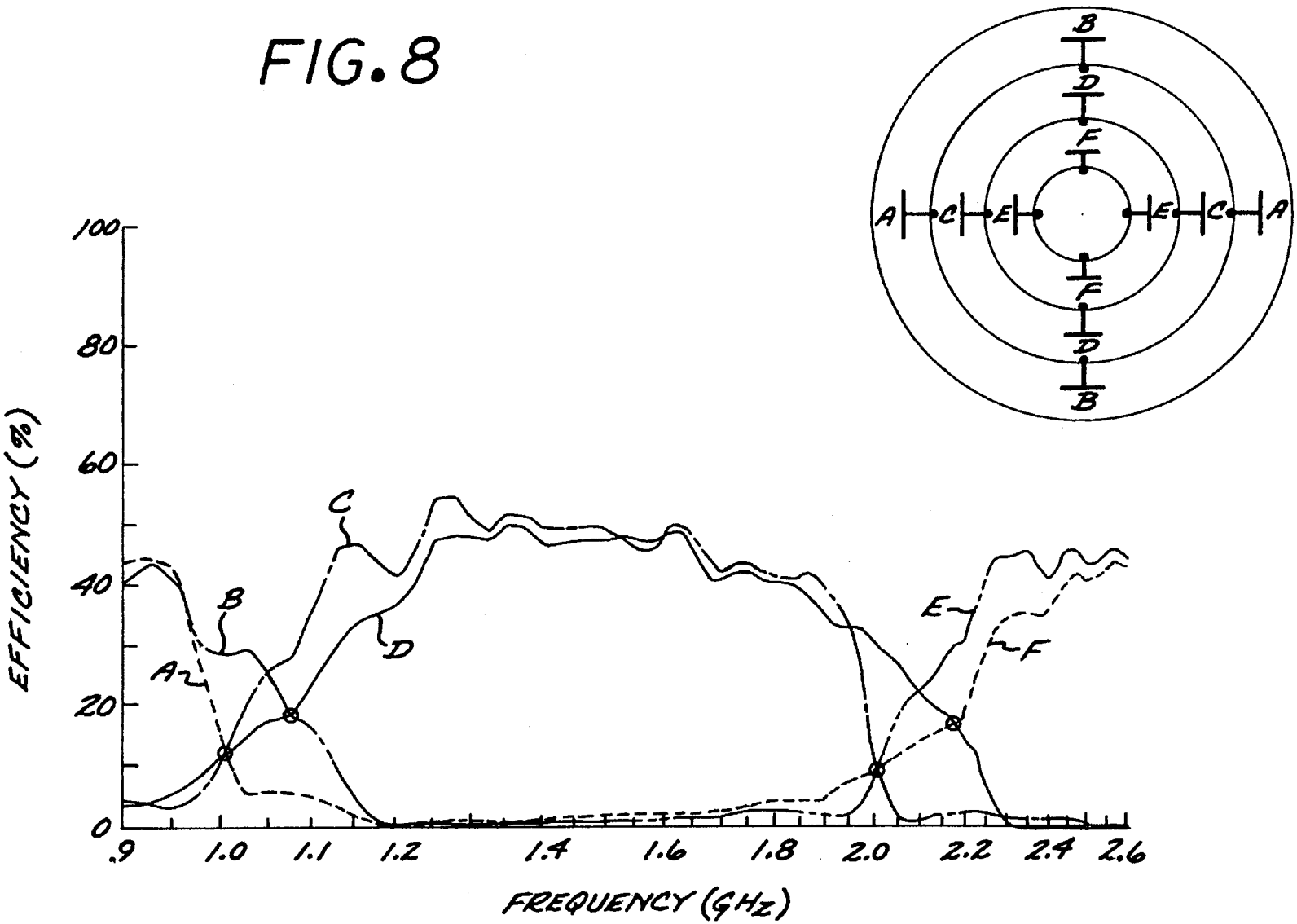
FIG. 8 is a plot of efficiency versus frequency for an antenna feed system in accordance with the invention.

A feed system embodying the invention was mounted at the focal point of a 10-foot diameter parabolic reflector, and swept gain measurements were taken. A plot of antenna gain, expressed in terms of efficiency versus frequency, is shown in FIG. 8 for the second lowest octave band feed cavity plus portions of the bands of the two adjacent octave cavities. Curves A, C, and E in the figure represent the efficiency performance for collinearly polarized dipole elements of the three lowest octave cavities, while curves B, D, and F are for the orthogonally polarized dipole elements. The lower crossover frequencies are seen to be staggered about 7.0 percent, while the upper crossover frequencies are staggered about 8.5 percent. The ability of such a feed to capture energy for at least one linear polarization has increased, as seen by the crossover points of curves B and C and curves D and E. The crossover levels are about 11 percent for a nested cup dipole feed as described in U.S. Pat. No. 4,042,935. The data of FIG. 8 is for a feed having staggered crossover frequencies; however, if crossover staggering is not desired for an application, both the collinear gain responses would be similar to curves A, C, and E. The average in-band efficiency for this embodiment is 47 percent.

It will be understood that, while the operation of the feed system has been described in some respects in terms of transmit operation, the feed system is capable of reciprocal transmit and receive operations.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A collinearly polarized nested cup dipole feed system, comprising:

a plurality of coaxially disposed conductive cylinders of progressively larger diameters disposed about a common axis, said conductive cylinders being closed at one end thereof to define a plurality of nested annular cavities with common wails there between and having open ends, the open ends of said cavities being aligned along the common axis;

first and second pairs of dipole elements disposed adjacent the open ends of each of said cavities and electromagnetically coupled thereto, said first pair of elements being disposed orthogonal to said second pair of elements of each cavity, and wherein said first pair of dipole elements are disposed along a first axis transverse to the common axis, said first pair of dipole elements for each cavity being aligned along the first transverse axis in a collinear arrangement, and said second pairs of dipole elements are disposed along a second axis transverses to the common axis, said second pair of dipole elements for each cavity being aligned along the second transverse axis in a collinear arrangement;

wherein for each cavity, said first pair of dipole elements are larger than said second pair of dipole elements, whereby said antenna feed system is characterized by a staggered crossover capability;

means for exciting said dipole elements of each pair with electromagnetic energy, wherein said feed system is characterized by dual linear polarization capabilities.

2. The feed system of claim 1 wherein for each cavity, said dipole elements disposed adjacent said cavity provide an antenna feed capability at a particular frequency range, wherein the frequency ranges of the elements for the respective cavities are at octave spacing relative to the frequency range for adjacent cavities, and wherein the respective frequency ranges for adjacent cavity dipole pairs of the same polarization define a frequency crossover.

3. The feed system of claim 2 wherein the respective crossover frequencies for the frequency ranges of adjacent cavity dipole pairs of the same polarization are offset from the respective crossover frequency ranges of adjacent cavity dipole pairs of the opposite polarization.

4. The feed system of claim 1 wherein said means for exciting said dipole elements of said pair further comprises means for introducing a 180 degree phase shift between the dipole elements in each pair.

5. The antenna feed system of claim 4 wherein said exciting means comprises means for dividing an input power source into two signals of substantially equal power but with a 180 degree phase difference between said two signals, whereby said dipole elements of said pair are excited by substantially equal signals which are out of phase.

* * * * *